United States Patent [19]

Stemp

[11] 4,122,913

[45] Oct. 31, 1978

[54] SILENCER

[76] Inventor: Leslie W. Stemp, 3089 Jaguar Valley Dr., Mississauga, Ontario, Canada, L5A 2J1

[21] Appl. No.: 712,482

[22] Filed: Aug. 9, 1976

[51] Int. Cl.[2] ..... F01N 1/04; F01N 1/08; F01N 1/12

[52] U.S. Cl. ..... 181/256; 181/264; 181/279

[58] Field of Search ..... 181/55, 53, 50, 66, 181/62, 49, 42, 256, 252, 267, 279, 264

[56] References Cited

U.S. PATENT DOCUMENTS

| | | | |
|---|---|---|---|
| 681,522 | 8/1901 | Very | 181/55 |
| 701,496 | 6/1902 | McKinnie | 181/50 |
| 1,680,671 | 8/1928 | Eschholz | 181/55 |
| 2,644,389 | 7/1953 | Dauphinee | 181/50 |
| 3,692,142 | 9/1972 | Stemp | 181/66 |
| 3,927,731 | 12/1975 | Lancaster | 181/256 |

FOREIGN PATENT DOCUMENTS

| | | | |
|---|---|---|---|
| 1,364,100 | 8/1974 | United Kingdom | 181/256 |

*Primary Examiner*—Stephen J. Tomsky
*Attorney, Agent, or Firm*—K. Maxwell Hill

[57] ABSTRACT

A silencer consists of concentric spaced apart longitudinally extending shells connecting two bulkheads, each having an outer imperforate face, the space between the faces of each shell containing noise absorbing material such as rock wool. Each shell has a longitudinally extending duct to enable the gases to escape, the duct in the inner shell being offset in relation to the duct in the next shell; the inner shell is connected to the inlet pipe and the gases escape via the duct of the inner shell, then through the space separating the two shells and finally through the duct of the next shell.

2 Claims, 2 Drawing Figures

SILENCER

FIELD OF THE INVENTION

This invention relates to silencers of the through type for moving gases and particularly to the silencing of gases discharged from internal combustion engines.

PRIOR ART

Silencers of the through type generally include an outer shell with leaders connecting an inner shell entirely free of baffles but provided with perforations leading into an annular space between the shells. Silencers of this type offer an advantage in that they are free of back pressure and if noise absorbing means is provided between the shells, this type of silencer is a common means for attenuating the noise which takes place when an internal combustion engine is moving.

However, the efficiency of a silencer depends on an adequate length of travel for the gases and through type silencers tend to be of inordinate length to achieve the requisite attenuation; also, the larger the engine, the larger the silencer to effect the same attenuation in decibels to the required level. In recent years, limits have been placed in many countries on the amount of noise which may be emitted from an engine when running. A particularly difficult problem is to effect the requisite attenuation in diesels used for industrial purposes and silencers used under these conditions are cumbersome and expensive.

A number of proposals have been made to make silencers wherein the length of travel of the gases is increased without increasing the overall length of the silencer; for instance it has been proposed to have a spiral tube arrangement to improve the efficiency without increasing the length. The production of such a spiral type of silencer presents difficulties in accurately forming the sheet to the required shape.

It is an object of the present invention to provide a silencer of the type described that allows the gases to enter both ends of the silencer, thereby being particularly useful for 'V' engines where normally two silencers are needed; i.e. one for each bank of cylinders. The object is to eliminate the need for two silencers as the exhaust gases from each bank of cylinders enter each end of the silencer and are ducted away through one pipe.

As silencer sizes get larger in an endeavour to meet noise legislation, and more pollution and other equipment is required on installations, there is a great demand for a compact silencer. The object herein is to provide such a device. By increasing the size of the silencer at the same time making it compact, very high attenuations can be attained — reducing exhaust noise levels bordering on that of the inaudible.

With the emphasis and need today for the conservation of energy, the engine performance can be improve by the use of the present invention because it provides very low back pressure.

It is therefore, the object of the invention to provide a simple, compact and inexpensive silencer, attachable to one or more inlet pipes to attenuate the sound waves issuing from the pipe or pipes.

SUMMARY OF THE INVENTION

The silencer of the invention consists of concentric spaced apart longitudinally extending shells, connecting two bulkheads, each shell having an outer imperforate face and an inner perforate face, the space between the faces of each shell containing noise absorbing material such as rock wool. Each sheel has a longitudinally extending duct to enable the gases to escape, the duct in the inner shell being offset in relation to the duct in the next shell; the inner shell is connected to the inlet pipe and the gases escape via the duct of the inner shell, then through the space separating the two shells and finally through the duct of the next shell.

BRIEF DESCRIPTION OF THE DRAWINGS

The invention will now be described in relation to the accompanying drawings in which.

DESCRIPTION OF THE PREFERRED EMBODIMENT

According to the present invention it is desired to increase the length of travel of the gases for a given length in a silencer thus attenuating the noise but back pressure is minimised by permitting the gases to move easily in a direction away from the inlet pipe.

Figure 1:
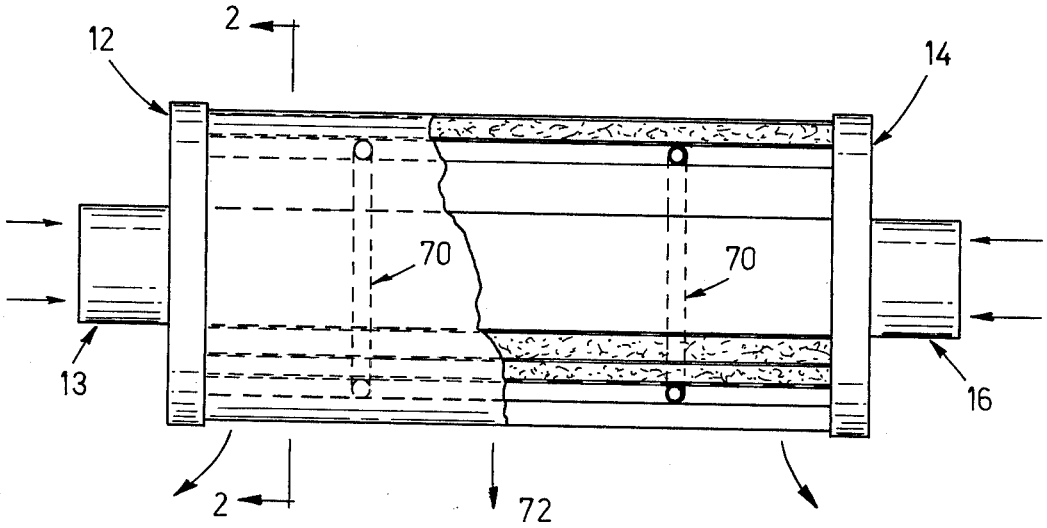
FIG. 1 is a side view of a silencer constructed according to the invention.

As shown in FIG. 1 the silencer comprises a pair of spaced apart end plates or bulkheads 12 and 14. Exhaust inlet pipes 13 and 16 are secured to the bulkheads 12 and 14 respectively.

Connecting the bulkheads 12 and 14 and extending longitudinally are a first pair of cylindrical shells generally denoted by the numerals 25 and 26. The inlet pipes 13, 16 may project a short distance through the bulkheads 12, 14 to locate the position of the shell 25 so it surrounds the pipes 13, 16. The end of pipe 13 is shown as a wall in FIG. 2 inside wall 24.

Figure 2:
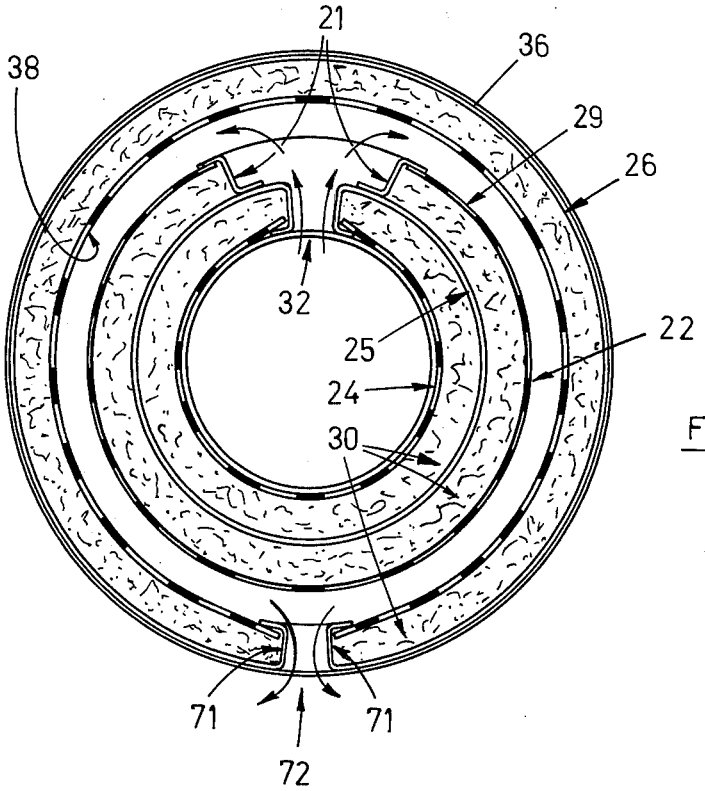
FIG. 2 is a cross section taken on the lines 2—2 of the silencer shown in FIG. 1 and showing a preferred arrangement of the shells.

The imperforate shell 25, shown to be semi-circular in cross section in FIG. 2, has an outer perforate wall 22 and an inner perforate wall 24. These walls 22, 24 may be secured together, as shown, in a simple and inexpensive manner by inserting the curled ends of shell 25 and "Z" section 21 to lock walls 22, 24 in position.

The shells 25 and 26 each contain noise absorbing material 30 such as rock wool. The amount and hence density of noise absorbing material 30 depends on the desired attenuation but for ease of assembly the rock wool may be attached to either the inside of the wall 24 or the wall 21 before they are placed in position.

It will be observed from FIG. 2 that the ends 21 of shell 25 and ends 71 of shell 26 are spaced apart to provide a pair of opposed ducts 32, 72, each of which substantially extends the length of each shell 25 and 26. The ducts 32, 72 are shown to be diametrically opposed but this is not essential to the invention.

The shells 25, 26, or tubes have slots 32, 72 respectively, running their length between the bulkheads and are flanged as shown by wall 71 of shell 26 to contain the perforated metal retainers or walls 22 and 24. Retainer means 21 are attached to the outer surface of shell 25 to contain the perforated metal retainer 24 in close contact with shell 25. The rings 70 are located between wall 22 and wall 38 to ensure the required gap between them. The space between the retainers and tubes is filled with acoustic wool 30, preferably rock wool because of its high operating temperature and its resistance to acids.

Gases enter both ends 13, 16, of the silencer and leave through the slot 72. If desired, the gases may enter from one end only in which case the one inlet pipe can be omitted and end plate blanked off. Many types of ducting may be attached to the outlet slot 72 to guide the gases away in different directions. In particular, if the end plate 14 is blanked off, the silencer can be inserted into a circular duct a little larger than plate 12 and attached to end plate 12. This arrangement allows the gases to leave the silencer in the same direction as they enter.

Cylinder shell 26 is constructed of an outer imperforate wall 36 and an inner perforate wall 38 with noise absorbing material 30 disposed between the walls 36 and 38. The ends 71 of shell 26 provide a pair of walls which form a duct or slot 72.

It is a requirement of the invention that the duct slot 32 of the inner shell 25 should be offset in relation to the duct slot 72 of the outer shell 26; in this manner, the path of the gases illustrated by the arrows in FIG. 2 is considerably extended, since after leaving the inner shell 25 through the duct 32, the gases have to travel along the space between the shells before they can exit through the ducts 72. It has been found that considerable attenuation of noise results from the enforced travel of the gases along that space.

The description above relates to an inner and outer shell but they may be increased in number as desired. Since the basic requirement is an inner and outer shell constructed as already described with off-setting ducts.

An alternative arrangement is having a trio of shells disposed inside an outer trio of shells; again the ducts between the inner trio of shells will be offset in relation to the ducts between the outer trio of shells.

The exhaust gases after passing through the duct 72 of the outer shell may be ducted away in any convenient manner. Conveniently a surrounding casing may be provided, the gases then leaving via the inlet pipes or in any suitable direction.

I claim:

1. A silencer for absorbing the noise energy carried with the exhaust gases of an internal combustion engine, while freely moving the gases throughout the silencer without increase of back-pressure to the engine by the silencer comprising in combination;

a substantially cylindrical body composed of an inner shell and an outer shell concentrically fixed apart from one another to define an open space therebetween and having opposite ends thereto defining bulkheads to said body;

exhaust gas inlet means in each of said bulkheads to direct gas into the interior of said inner shell;

said outer shell having an outer imperforate wall and an inner perforate wall defining a space therebetween;

said inner shell having an imperforate wall with an inner and outer perforate wall spaced apart from said imperforate wall of said inner shell to define a space on either side thereof;

a slot-shaped duct extending through the inner shell between said bulkheads and having an opening area at least the total area of the combined gas inlet opening means;

a slot-shaped duct extending through the outer shell between the bulkheads diametrically opposite the slot-shaped duct extending through the the inner shell and having an opening area at least equal to the total area of the combined inlet means; and noise-energy absorbing material filling the spaces between the perforate and imperforate walls of the inner and outer shells;

thereby creating a passage for exhaust gases in said silencer having noise-energy absorbing walls for the whole interior of said silencer.

2. The silencer of claim 1 having rock wool as the noise-energy absorbent material therein.

* * * * *